US006155866A

United States Patent [19]

Liu et al.

[11] Patent Number: 6,155,866

[45] Date of Patent: Dec. 5, 2000

[54] CABLE CONNECTOR ASSEMBLY HAVING STRAIN RELIEF

[75] Inventors: Ricky Liu; Leslie Poe; Bred Ma, all of Kun-Shan, China

[73] Assignee: Hon Hai Precision Ind. Co., Ltd., Taipei Hsien, Taiwan

[21] Appl. No.: 09/387,887

[22] Filed: Sep. 1, 1999

[30] Foreign Application Priority Data

Jun. 11, 1999 [TW] Taiwan ..... 88209572

[51] Int. Cl.[7] ..... H01R 13/56

[52] U.S. Cl. ..... 439/447

[58] Field of Search ..... 439/447, 445, 439/470, 452

[56] References Cited

U.S. PATENT DOCUMENTS

| | | | |
|---|---|---|---|
| 4,203,004 | 5/1980 | Cox | 439/452 |
| 5,267,882 | 12/1993 | Davis | 439/680 |
| 5,340,330 | 8/1994 | Dolson et al. | 439/447 |
| 5,462,457 | 10/1995 | Schroepfer et al. | 439/447 |
| 5,494,457 | 2/1996 | Kunz | 439/447 |

*Primary Examiner*—Gary F. Paumen
*Attorney, Agent, or Firm*—Wei Te Chung

[57] ABSTRACT

A cable connector assembly comprises a connector subassembly including an electrical connector and a shell enclosing the connector, a cable terminated to the connector subassembly, and a strain relief device injection molded around the cable. The strain relief device includes a strain relief member and an integral interconnection member located in the connector subassembly for assembling the strain relief thereto. The strain relief member comprises a plurality of longitudinal portions arranged in two arrays for symmetrically flanking the cable, a plurality of parallel vertical portions interconnecting the longitudinal portions for sandwiching the cable therebetween, and a front portion connecting with the interconnection member. Each longitudinal portion has a substantially trapezoidal vertical cross section being tapered toward the cable. The height of the vertical cross section of each longitudinal portion proximate the retained cable is much smaller than the diameter of the cable in a vertical direction.

7 Claims, 6 Drawing Sheets

CABLE CONNECTOR ASSEMBLY HAVING STRAIN RELIEF

BACKGROUND OF THE INVENTION

1. Field of the Invention

The present invention relates to a cable connector assembly, and particularly to a strain relief of a cable connector assembly with a cable retained therein along a central axis thereof.

2. Description of Prior Art

A strain relief is commonly used for a cable connector assembly to ensure a reliable electrical connection between conductors of a cable of the connector assembly and terminals of a cable end connector when an external force acts on the cable. The external force may be caused by outwardly pulling the cable to separate the cable end connector from a mated electrical connector. The strain relief is integrally injection molded around the cable. With such an arrangement, not only is the ability of the cable for resisting an external force enhanced, but manufacture is also facilitated. The strain relief is dimensioned in proportion to an external force acting thereon and the intensity thereof. Pertinent conventional strain relieves are disclosed in U.S. Pat. Nos. 5,494,457, 5,267,882, U.S. Des. Nos. 349,099, 349,100, and Taiwan Patent Application Nos. 80210763 and 83201276.

A conventional strain relief 7 of a cable connector assembly similar to the disclosures of U.S. Des. No. 349,100 and Taiwan Patent Application No. 80210763 is shown in FIG. 1. The strain relief 7 comprises a plurality of central longitudinal members 8 arranged in two arrays and a plurality of parallel tab members 9 interconnecting the central longitudinal members 8. Each central longitudinal member 8 is rectangular and has a height approximately equal to a vertical diameter of a cable 6 rearwardly extending from the connector assembly. To injection mold the strain relief 7 around the cable 6, a mold (not shown) is employed with a cavity defined therein for receiving the cable 6. An injection gate is formed in one side of the mold in a position corresponding to an intersectional portion of the longitudinal member 8 and the tab member 9 at an end of the strain relief 7. The injection gate is adapted to receive a nozzle (not shown) for injecting molten plastic into the mold.

Since the molten plastic is injected into the mold from one side thereof and no effective retention means is provided on the mold, the cable 6 tends to move toward an opposite side of the mold and deforms due to high pressure exerted during injection molding, as shown in FIG. 2. When the molten plastic solidifies, the strain relief 7 is formed with the cable 6 encapsulated therein being offset from a central axis thereof. Thus, the widths of the opposite longitudinal members 8 of the strain relief 7 are different resulting in a poor appearance, as shown in FIG. 3. In addition, the unsymmetrical configuration of the stain relief device 7 exerts an interior stress thereby adversely affecting the function and life span thereof.

SUMMARY OF THE INVENTION

Accordingly, an object of the present invention is to provide a cable connector assembly having a strain relief with a cable retained therein along a central axis thereof.

In order to achieve the object set forth, a cable connector assembly in accordance with the present invention comprises a connector subassembly consisting of an electrical connector and a shell enclosing the connector, a cable terminated to the connector subassembly, and a strain relief injection molded around the cable. The strain relief includes a strain relief member and an integral interconnection member located in the connector subassembly.

The interconnection member of the strain relief has a planar shape and comprises a U-shaped cutout in a front end thereof for extension of the cable therethrough. A pair of holes is formed in the interconnection member proximate opposite sides of the cutout for engaging with corresponding pegs extending from inner surfaces of the shell thereby assembling the strain relief to the connector subassembly.

The strain relief member of the strain relief comprises a plurality of longitudinal portions arranged in two arrays for symmetrically flanking the cable, a plurality of parallel vertical portions interconnecting the longitudinal portions for sandwiching the cable therebetween, and a front portion connecting with the interconnection member. Each longitudinal portion has a substantially trapezoidal vertical cross section being tapered toward the cable. The height of the vertical cross section of each longitudinal portion proximate the retained cable is significantly smaller than the diameter of the cable in a vertical direction.

To obtain such a strain relief with the cable retained therein along the central axis thereof, a mold having opposite protrusions is applied to retain the cable in position during injection molding.

Other objects, advantages and novel features of the invention will become more apparent from the following detailed description when taken in conjunction with the accompanying drawings.

DETAILED DESCRIPTION OF THE INVENTION

Figure 1:
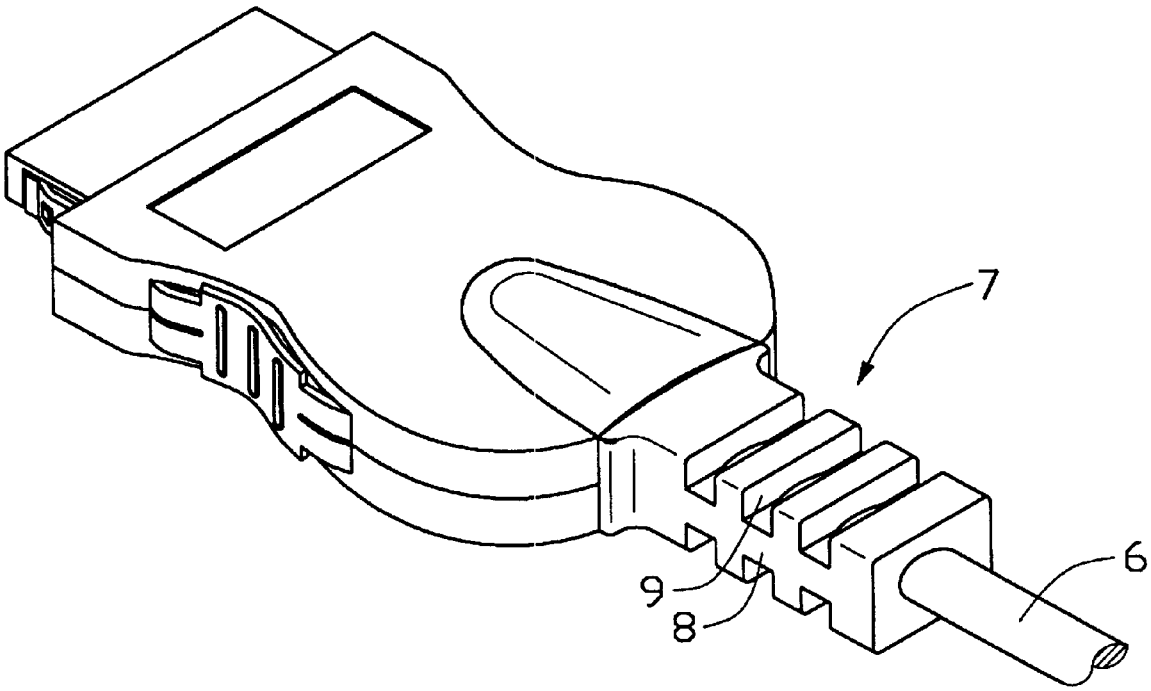
FIG. 1 (PRIOR ART)
FIG. 1 is a perspective view of a cable connector assembly incorporating a conventional strain relief.
Figure 2:
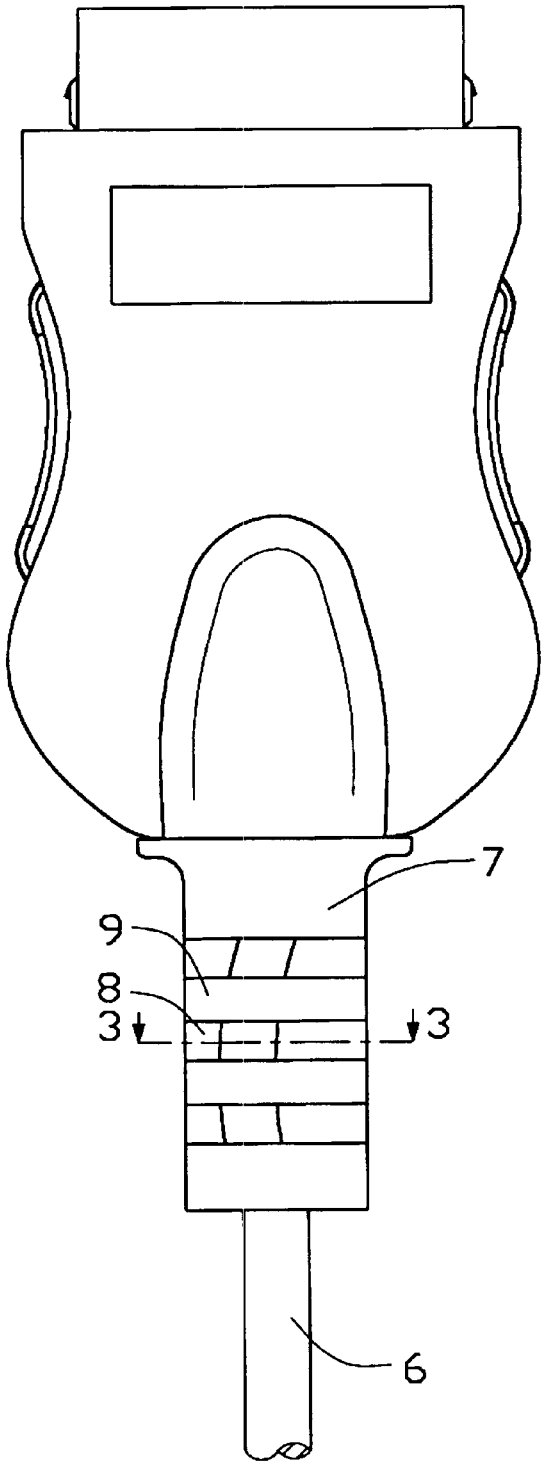
FIG. 2 (PRIOR ART)
FIG. 2 is a top plan view of FIG. 1.
Figure 3:
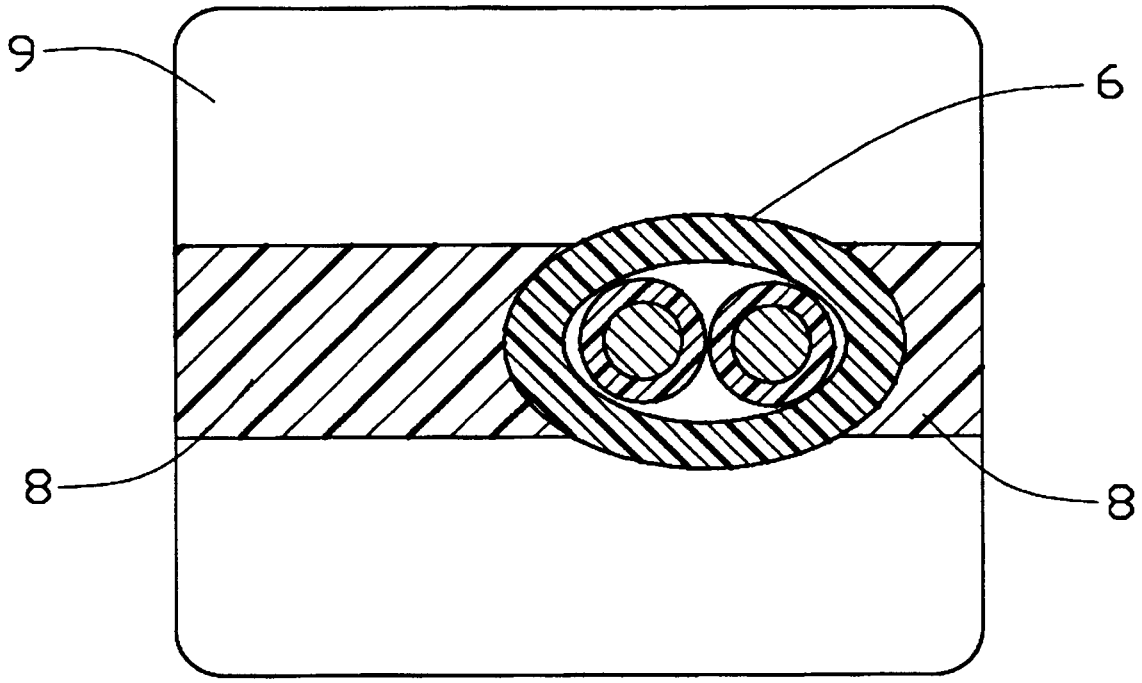
FIG. 3 (PRIOR ART)
FIG. 3 is a cross-sectional view taken along line 3—3 of FIG. 2.
Figure 4:
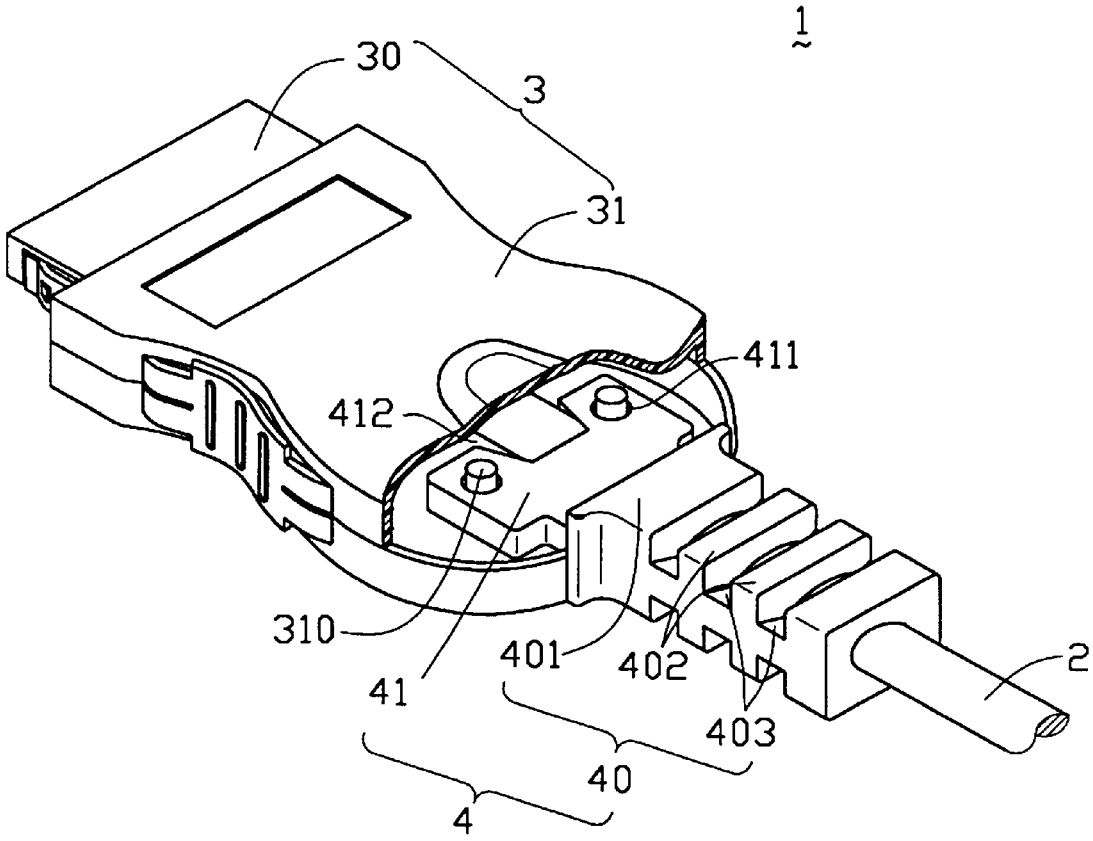
FIG. 4 is a perspective view of a cable connector assembly incorporating a strain relief in accordance with the present invention, the cable connector assembly being partially cutout away to show an interconnection member thereof.
Figure 6:
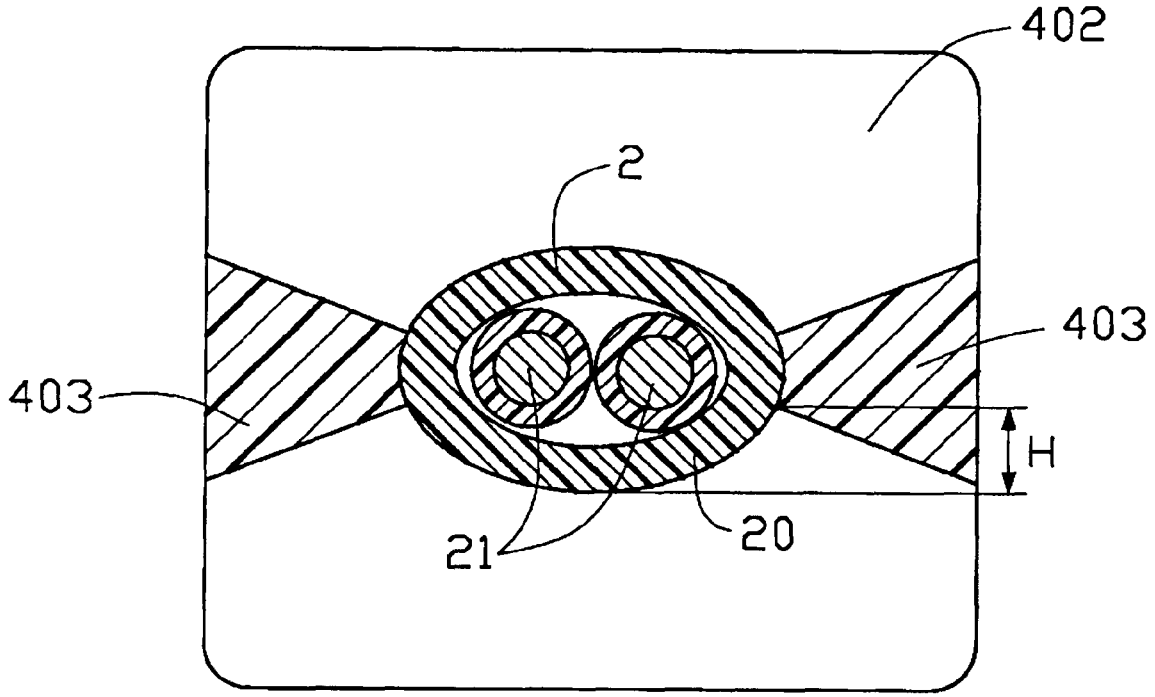
FIG. 6 is a cross-sectional view taken along line 6—6 of FIG. 5.

Referring to FIGS. 4 and 6, a cable connector assembly 1 in accordance with the present invention comprises a connector subassembly 3, a cable 2 terminated to the connector subassembly 3, and a strain relief 4 injection molded around the cable 2. The connector subassembly 3 consists of an electrical connector 30 and a shell 31 enclosing the connector 30. The cable 2 consists of a plurality of single conductive wires 21 and an insulative sheath 20 enclosing the conductive wires 21. In this embodiment, only two conductive wires 21 are shown. Each conductive wire 21 is terminated to a corresponding contact (not shown) of the connector 30. The connector 30 projects from the connector subassembly 3 for connecting with a mating connector (not shown).

The strain relief 4 is injection molded around the cable 2 and consists of a strain relief member 40 and an interconnection member 41. The strain relief member 40 includes a front portion 401, a plurality of longitudinal portions 403 arranged in two arrays for flanking the cable 2, and a plurality of parallel vertical portions 402 interconnecting the longitudinal portions 403 for sandwiching the cable 2. The front portion 401 is adapted for abutting against outer surfaces of the shell 31 thereby assembling the strain relief 4 to the connector subassembly 3 in cooperation with the interconnection member 41. The interconnection member 41 integrally extends from the front portion 401 of the strain relief member 40 with a cutout 412 formed on a front end thereof for the extension of the cable 2 therethrough. A pair of holes 411 is formed in the interconnection member 41 proximate opposite sides of the cutout 412 for engaging with corresponding pegs 310 extending from inner surfaces of the shell 5 thereby retentively attaching the strain relief 4 thereto. By such a design, an external force acting on the cable 2 is transferred from the joints between the conductive wires 21 of the cable 2 and the corresponding contacts of the connector 3 to the strain relief 4 thereby ensuring a reliable connection therebetween. Although the front portion 401 of the strain relief member 40 is separated from the shell 31 of the connector subassembly 3 in this embodiment, it is known to those skilled in the art that the front portion 401 also can be integrally molded with the shell 31 without the need of the interconnection member 41.

The longitudinal portions 403 of the strain relief member 40 are symmetrically formed beside the cable 2. A section of each longitudinal portion 403 abutting against the cable 2 has a height significantly smaller than the diameter of the cable 2 in a vertical direction. A distance H exists between the abutting section of each longitudinal portion 403 and a lowest portion of the cable 2. To maintain the intensity of the strain relief 4, each longitudinal portion 403 is tapered in a transverse direction toward the cable 2 to form a substantially trapezoidal vertical cross section.

Figure 5:
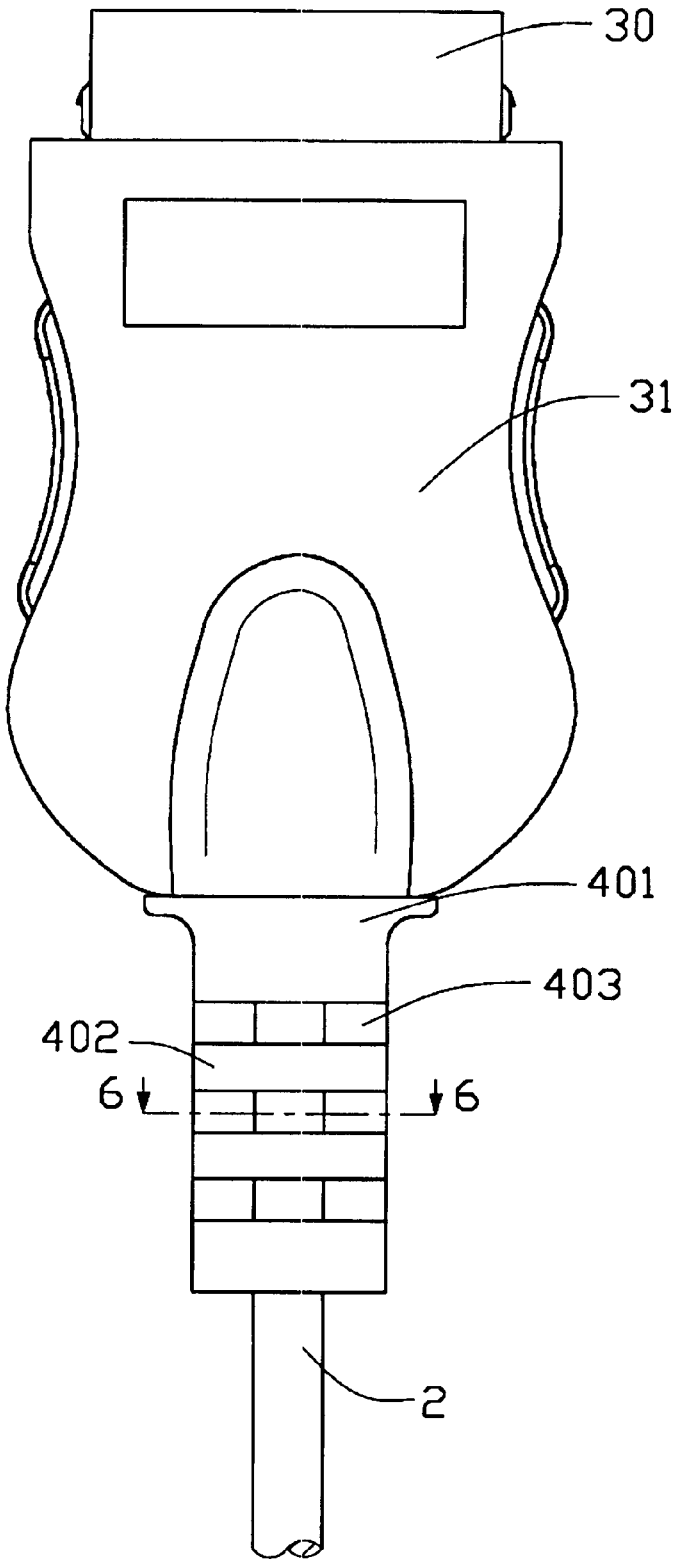
FIG. 5 is a top plan view of FIG. 4.

To injection mold the strain relief device 4, a mold assembly (not shown) having a top mold and a bottom mold coupled together is employed. Each of the top and bottom mold comprises a plurality of spaced ribs along a longitudinal direction thereof. Corresponding to the configuration of the longitudinal portion 403 of the strain relief member 40, each rib is configured to have opposite protrusions formed on opposite ends thereof to securely retain the cable 2 along its central axis in the mold. The opposing protrusions of the top and bottom molds cooperate to define cavities therebetween to form the corresponding longitudinal portions 403 of the strain relief device 4. Thus, when a nozzle (not shown) is inserted into a gate formed in one side of the mold assembly for injecting molten plastic into the cavities defined by the protrusions, the cable 2 will not be displaced to an opposite side of the mold assembly due to the provision of the protrusions of the mold assembly. Therefore, after the molten plastic solidifies, a strain relief 4 with the cable 2 retained therein along a central axis thereof is achieved, as best shown in FIG. 5.

Due to the improved mold, the strain relief 4 having a good appearance is achieved. Since the cable 2 is retained in the strain relief 4 along a central axis thereof, interior stress is eliminated thereby prolonging the life of the strain relief 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A cable connector assembly comprising:

a connector subassembly including an electrical connector and a shell enclosing the connector;

a cable terminated to the connector subassembly; and a strain relief being injection molded around the cable at a position where the cable terminates to the connector subassembly, the strain relief comprising a plurality of longitudinal portions arranged in two arrays for flanking the cable, a plurality of parallel vertical portions interconnecting the longitudinal portions for sandwiching the cable, and a front portion secured to the connector subassembly, each longitudinal portion having a substantially trapezoidal vertical cross section tapering toward the cable, the longitudinal portion proximate the cable having a height significantly smaller than the diameter of the cable in a vertical direction, the strain relief being formed by the steps of:

positioning the cable in a mold assembly comprising a top mold and a bottom mold coupled together, each mold having spaced ribs along a longitudinal direction thereof, each rib having a pair of protrusions formed on opposite ends thereof for sandwiching the cable therebetween to retain the cable along a central axis of the cable during molding, the opposing protrusions of the top and bottom molds cooperating to define cavities therebetween; and injecting molten plastic into the cavities of the mold assembly through a gate defined in one side of the mold assembly to form corresponding longitudinal portions of the strain relief.

2. The cable connector assembly as described in claim 1, wherein the strain relief further comprises an interconnection member integrally extending from the front portion, the interconnection member being located in and connected to the connector subassembly.

3. The cable connector assembly as described in claim 2, wherein the interconnection member has a planar shape and comprises a pair of opposite holes, and the shell of the connector subassembly comprises a pair of pegs extending from inner surfaces thereof for engaging in the holes.

4. A strain relief of a cable connector assembly injection molded around a cable at a position where the cable terminates to a connector subassembly, the connector subassembly comprising an electrical connector and a shell enclosing the connector, the strain relief comprising:

a plurality of longitudinal portions arranged in two arrays for flanking the cable, each longitudinal portion having a substantially trapezoidal vertical cross section tapering toward the cable, the longitudinal portion proximate the cable having a height significantly smaller than the diameter of the cable in a vertical direction, the longitudinal portions being formed by cavities defined between opposing protrusions of a mold assembly, the mold assembly comprising a top mold and a bottom mold coupled together, each mold having spaced ribs along a longitudinal direction thereof, the protrusions being formed on opposite ends of each rib for sandwiching the cable therebetween to retain the cable along a central axis of the cable during injection molding;

a plurality of integrally molded parallel vertical portions interconnecting the longitudinal portions for sandwiching the cable; and an integrally molded front portion being connected the connector subassembly.

5. The strain relief as described in claim 4, further comprising an interconnection member integrally extending from the front portion, the interconnection member being located in and connected to the connector subassembly.

6. The strain relief as described in claim 5, wherein the interconnection member has a planar shape and comprises a pair of opposite holes, and the shell of the connector subassembly comprises a pair of pegs extending from inner surfaces thereof for engaging in the holes.

7. A cable connector assembly comprising:

a connector subassembly including an electrical connector and a shell enclosing the connector;

a cable terminated to the connector subassembly; and a strain relief being injection molded around the cable adjacent to a position where the cable terminates to the connector subassembly, said strain relief including two arrays of longitudinal portions on opposite sides of the cable, and a plurality of parallel vertical portions interconnecting the longitudinal portions in an alternative arrangement for holding the cable; wherein each of said longitudinal portions is shaped like a trapezoid, of which a relatively shorter side is interconnected to the cable and a relatively longer side is exposed to an exterior, a dimension of said relatively shorter side also being significantly smaller than a diameter of the cable in a vertical direction.

* * * * *